US007857922B2

(12) United States Patent
Smith et al.

(10) Patent No.: US 7,857,922 B2
(45) Date of Patent: Dec. 28, 2010

(54) PRESSABLE PLASTIC-BOUND EXPLOSIVE COMPOSITION

(75) Inventors: Kjell-Tore Smith, Sætre (NO); Øyvind Hammer Johansen, Oslo (NO); Erlend Skjold, Sætre (NO); Richard Gjersoe, Heer (NO)

(73) Assignee: Dyno Nobel ASA, Saetre (NO)

( * ) Notice: Subject to any disclaimer, the term of this patent is extended or adjusted under 35 U.S.C. 154(b) by 282 days.

(21) Appl. No.: 10/717,461

(22) Filed: Nov. 21, 2003

(65) Prior Publication Data

US 2005/0072503 A1 Apr. 7, 2005

(30) Foreign Application Priority Data

Oct. 6, 2003 (NO) ..... 20034475

(51) Int. Cl.
*C06B 25/34* (2006.01)

(52) U.S. Cl. ..... 149/92

(58) Field of Classification Search ..... 149/92
See application file for complete search history.

(56) References Cited

U.S. PATENT DOCUMENTS

| | | | | |
|---|---|---|---|---|
| 4,065,529 | A * | 12/1977 | Lavertu et al. | 264/3.6 |
| 4,163,681 | A * | 8/1979 | Rothenstein et al. | 149/11 |
| 4,298,411 | A * | 11/1981 | Godsey | 149/19.4 |
| 4,638,065 | A * | 1/1987 | Svensson et al. | 544/196 |
| 5,067,996 | A | 11/1991 | Lundstrom et al. | |
| 6,485,587 | B1 * | 11/2002 | Han et al. | 149/19.92 |
| 6,884,307 | B1 * | 4/2005 | Hofmann et al. | 149/92 |
| 2003/0127166 | A1 | 7/2003 | Rudolf | |
| 2003/0192629 | A1 | 10/2003 | Hofman et al. | |
| 2003/0192631 | A1 | 10/2003 | Hofman et al. | |

FOREIGN PATENT DOCUMENTS

| | | |
|---|---|---|
| DE | 3804397 | 9/1989 |
| DE | 19719073 | 11/1998 |
| DE | 10155885 A1 | 11/2001 |
| EP | 1352884 | 10/2003 |
| EP | 1352885 | 10/2003 |

OTHER PUBLICATIONS

Whelan et al. 1996. Velocity of Detonation and Charge Diameter in some RDX-Driven Heterogeneous Explosives: PBXW-115, PBXN-111, H-6 and Composition B. Weapons Systems Division Aeronautical and Maritime Research Laboratory. DSTO-TR-0400.*

Characteristics of The Insensitive Pressed Plastic Bonded Explosive, DXD-59, Hyoun-Soo Kim & Bang-Sam Park.

ISR in PCT/NO2004/00295.

Munitions Technology Symposium IV and Statistical Process Control.

Improved Insensitive Hytemp/DOA Bonded HMX and RDX Mixtures . . . Karl Rudolf.

ISR in PCT/NO2004/00295, Feb. 2005.

* cited by examiner

*Primary Examiner*—Karl E Group
(74) *Attorney, Agent, or Firm*—Christian D. Abel

(57) ABSTRACT

The present invention relates to pressable explosive compositions with enhanced sensitivity characteristics and processability. The explosive compositions are based on crystalline explosive crystals of 1,3,5-trinitro-1,3,5-triazacyclohexane (RDX) Type I alone or in combination with a smaller percentage of 1,3,5-tetranitro-1,3,5,7-tetrazacyclooctane (HMX) where the crystals are coated with a binder system consisting of a polyacrylic elastomer to which a plasticizer is added. These explosive compositions are produced in a so-called water-slurry process where the explosive crystals are washed in water whereupon a solution of the binder system is added. After the admixture the solvent is distilled off and the coated product is isolated by filtering.

38 Claims, 1 Drawing Sheet

PRESSABLE PLASTIC-BOUND EXPLOSIVE COMPOSITION

BACKGROUND

1. Field of the Invention

The present invention relates to pressable explosive compositions with enhanced sensitivity characteristics and processability.

2. Background

RDX and HMX are crystalline explosive compounds, whose use has been known in the field of military pressable explosive compounds for a number of years. Pressable explosive compositions are traditionally employed for making charges for use in ammunition.

The breakthrough came when in 1925 G. C. Hale described a detailed process for producing RDX by means of 99.8% nitric acid and hexamine. HMX was discovered a few years later when the use was introduced of acetic anhydride for increasing the RDX yield (the Bachmann process) where HMX was basically regarded as a by-product. After the Second World War a great deal of work was done in order to guide the process in the direction of increased yields of HMX and RDX.

Several types of RDX exist. Two of these are known by those skilled in the art as Type I and Type II, the main difference between them being that Type I contains less HMX (≦4%) and has a higher melting point (≧200° C.) than Type II (% HMX=4-17, melting point ≧190° C.) (Military specification: MIL-DTL-398D). RDX Type I and Type II are approximately identical to what a German specification ("Technische Lieferbedingungen 1376-802" (TL-1376-802)) describes as Type A and Type B respectively. RDX crystals contain slightly less energy, but are generally more stable and substantially cheaper to produce than HMX crystals.

From the point of view of safety, sensitivity to external influences is obviously an extremely important parameter for ammunition, and several countries have introduced requirements with regard to this. These are referred to as IM requirements (IM=Insensitive Munition). In order to attain these IM requirements, demands are also placed on the explosive employed in the ammunition. An important parameter in this respect is sensitivity to external heat influence. This parameter can be tested by means of the Fast Cook-off test. This Fast Cook-off test can be implemented by placing a pressed charge in a steel tube and sealing it at both ends. It is then heated rapidly until a reaction occurs, causing the tube to open. The reaction is graded from a Type I reaction to a Type V reaction. A Type I reaction will be a full detonation where the tube is split into many small fragments and a Type V reaction will mean that the tube is only cracked as a result of a pressure reduction. According to a German standard for low-sensitivity explosive ("Technische Lieferbedingungen 1376-800") (TL-1376-800) the explosive is required to produce only Type V reactions.

When RDX or HMX are employed in ammunition, there are pressed into charges in order to achieve maximum density and thereby achieve maximum effect from the explosive. There will always be a certain risk involved in pressing explosive, and therefore every attempt is made to apply the lowest possible pressing pressure, generally referred to as improved pressability. Another advantage with improved pressability is that it will offer the producer the possibility of making much larger charges than is the case with explosive of inferior pressability. This will provide economic gains, particularly since alternatives to these large charges will involve the use of far more expensive production processes (castable/hardenable and meltable/hardenable processes).

It has been known for quite some time that in order to stabilise RDX and HMX crystals and make them suitable for pressing into charges, the crystals can be coated with a stabilising substance. To begin with different variants of wax were mainly employed for coating the crystals. Subsequently, more plastic materials have been employed, and in recent years compositions have been developed with more elastic plastic materials.

PRIOR ART

Today it is common practice to employ a polyacrylic elastomer together with a plasticizer for coating the RDX and HMX crystals. A well-suited elastomer is sold under the trade name Hy Temp 4454 or also called Hy Temp 4054 (marketed by Zeon Chemicals). This is a thermoplastic elastomer with a low glass transition temperature (Tg), which is a favourable feature for explosive compositions. A commonly used and well-suited plasticizer is, for example, dioctyl adipate (DOA). This elastomer and plasticizer form a binder system whose use has been known in compositions with HMX from the 1980' and somewhat later in RDX compositions.

A known RDX-based composition with this binder is PBXW-17, subsequently also known as PBXN-10, consisting of 94% RDX Type II (which contains some HMX) and 6% binder consisting of a 1:3 mixture of Hy Temp 4454 and DOA. This composition was first described in a lecture with associated article by Kirk Newman and Sharon Brown ("Munition Technology Symposium IV and Statistical Process Control Conference" in February 1997 in Reno, Nev.). Newman et al. described PBXW-17 produced in a water-slurry process where the binder, dissolved in ethyl acetate, was added in two portions. A number of studies of pressing amongst other things were carried out in this process. From the results of these studies it is claimed that it is difficult to press PBXW-17 to densities over 99% TMD (TMD is known to a person skilled in the art as theoretical maximum density). The reason why it is impossible to achieve higher density than 99% is claimed to be due to the binder's elastomeric character. Newman et al. further illustrate in a FIGURE that a pressing pressure of over approximately 1350 bar has to be applied in order to achieve over 98% TMD and that pressing pressure over 1520 bar does not noticeably increase the density.

Karl Rudolf (DE 101 55 855 A1) describes a new type of process for manufacturing an HMX or RDX-based composition with a mixture of Hy Temp 4454 and DOA as binder. The process described employs wetting of pre-dried explosive crystals with polysiloxane before the actual binder is added. This advance wetting with polysiloxane is extremely important for the properties of the product since it leads to a better contact between crystal and binder, which in turn results in pores being sealed, thereby reducing the proportion of what a person skilled in the art will call "hot spots". By sealing these pores and "hot spots" the sensitivity of the product will be enhanced and the density of the "granulates" will be high. Those explosive crystals which are pre-treated with polysiloxane are added to a solution of the binder. The binder is dissolved in a mixture of the solvents ethanol, ethyl acetate and acetone. This mixture is then mixed by means of a Drais mixer (type designation for a "High-Shear" mixer) before the solvent is removed by evaporation. The process described by Rudolf is conducted in dry phase and is therefore completely different from and considerably less safe than the well-known traditional industrially available water-slurry process where the explosive crystals are treated in a wetted phase.

Karl Rudolf presented a similar process in a presentation held in Florida in 2003. (2003 Insensitive Munitions and Energetic Materials Technical Symposium, 10-13 March 2003 in Orlando, U.S.A.). In this presentation a description was given amongst other things of an RDX composition consisting of 8% binder and 92% RDX Type II in a 70:30 ratio of class 3 and class 8 (the classification is described in MIL-DTL-398D) which have an average diameter of approximately 350 and approximately 65 microns respectively. In the presentation it states that if RDX Type I is employed, at least 5% HMX must be added in order to pass the Fast Cook-off test. On the other hand, the Fast Cook-off test is not passed when the water-slurry process is used to produce the composition. Rudolf indicates a pressability of over 98% TMD for the composition with a pressing pressure of 1200 bar. It is also maintained that the pressability is improved as a result of using a coarser fine portion than normal in the crystal mixture.

In the light of the above, it is clear that a need exists for cheap explosive compositions based on the raw material RDX which is optimally pressable, satisfies the IM requirements and which can be produced in existing industrial processing plants based on the relatively safe water-slurry process.

THE OBJECT OF THE INVENTION

It is therefore an object of the present invention to provide an explosive composition based on pure RDX or RDX with the addition of some HMX, where the composition can be produced by means of the water-slurry process, and where the composition satisfies current IM requirements.

It is also an object of the present invention to provide an explosive composition based on pure RDX or RDX with the addition of some HMX, and where the composition displays a superior pressability compared to present day compositions based on RDX and HMX.

SUMMARY OF THE INVENTION

The explosive compositions are based on crystalline explosive crystals of 1,3,5-trinitro-1,3,5-triazacyclohexane (RDX) Type I alone or in combination with a smaller proportion of 1,3,5-tetranitro-1,3,5,7-tetrazacyclooctane (HMX). The crystals are coated with a binder system consisting of a polyacrylic elastomer to which a plasticizer is added. These explosive compositions are produced in a so-called water-slurry process where the explosive crystals are washed in water whereupon a solution of the binder system is added. After the admixture the solvent is distilled off and the coated product is isolated by filtering.

BRIEF DESCRIPTION OF THE DRAWINGS

The invention will be described in detail with reference to following FIG. 1, which is graphical representation of pressing curves.

DETAILED DESCRIPTION OF THE INVENTION

Figure 1:
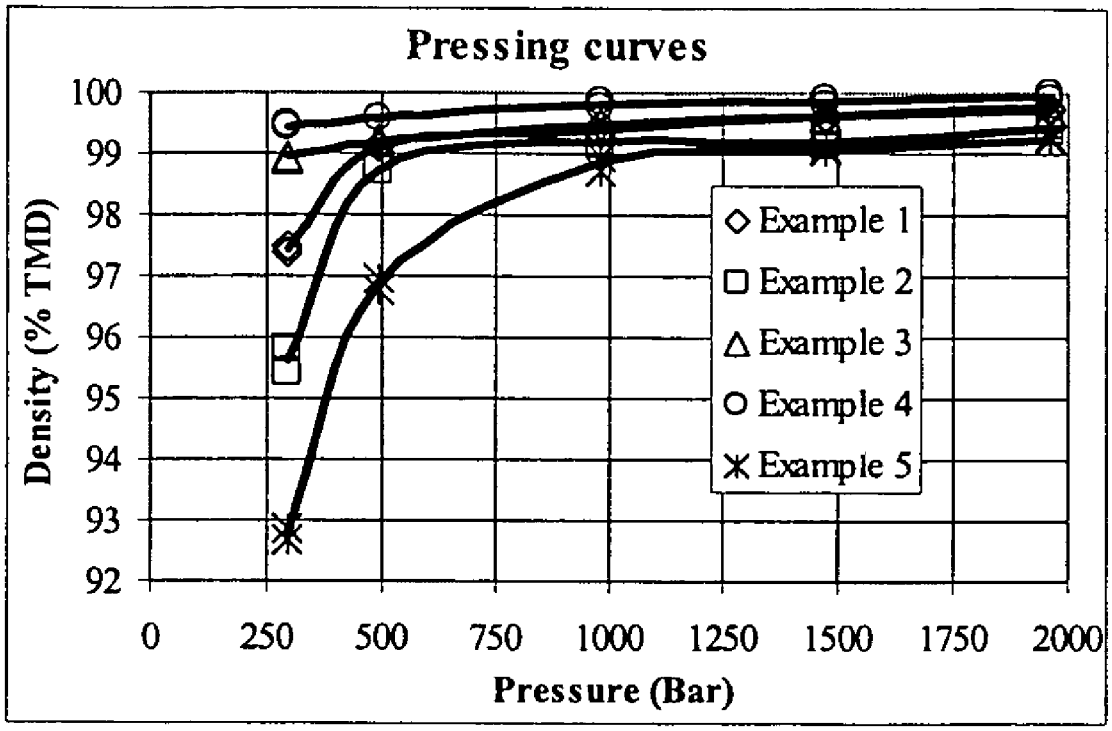

The objects of the invention can be achieved by means of the features set forth in the following description and attached patent claims.

The present invention relates to pressable explosive compositions with enhanced sensitivity characteristics and processability. The explosive compositions according to the invention are based on crystalline explosive crystals of 1,3,5-trinitro-1,3,5-triazacyclohexane (RDX) Type I alone or in combination with a smaller proportion of 1,3,5-tetranitro-1,3,5,7-tetrazacyclooctane (HMX), where the crystals are coated with a binder system consisting of a polyacrylic elastomer to which a plasticizer is added. These explosive compositions are produced in a so-called water-slurry process where the explosive crystals are washed in water, whereupon a solution of the binder system is added. After the admixture the solvent is distilled off and the coated product is isolated by filtering. The water-slurry process is very familiar to a person skilled in the art and requires no further description.

It has been demonstrated that the explosive compositions according to the invention have very good pressability properties. 99% TMD can be achieved with a pressing pressure as low as approximately 250 bar. From the point of view of Karl Rudolf's article which was presented in Florida in March 2003, this is very surprising since the skilled person is told therein that a pressure of the order of 1250 bar is required in order to achieve a TMD of 98%. The inventors are not sure of the reason for this improved pressability but assume that it is due to the use of fine-grained crystals. This is also surprising in the light of Rudolf's article since it maintains that the pressability increases with the use of large crystals. According to Rudolf higher densities can be achieved when pressing using 45 micron particles than 15 micron particles.

The improved pressability in the present invention where finer particles are employed is therefore highly unexpected for a person skilled in the art. As a result, the present invention will lead to economic gains in industrial connections since presses with lower pressing pressure can be used. The use of lower pressing pressure will also have an advantage with regard to safety. There will always be a certain risk involved in pressing explosives. By using the compositions according to the present invention the risk will be greatly reduced.

With the present invention compared to the state of the art, advantages are also obtained in that much larger charges can be produced by means of pressing than a person skilled in the art will say is possible for pressed explosive compositions containing RDX. This will provide economic gains, particularly since alternatives for producing such large charges will be the use of far more expensive production processes (castable-hardenable and meltable-castable processes).

With the present invention compared to the state of the art the advantage is also obtained that addition of HMX results in an enhancement of Fast Cook-off characteristics. This is achieved despite the fact that the product is produced by a water-slurry method, which is not in accordance with the teaching in Rudolf's 2003 article. For a person skilled in the art the use of the water-slurry process is quite clearly to be preferred purely from a safety point of view. To have water present in processing of this type of explosive entails the need for powerful external influence in the form of heat, open fire, impact or friction to enable it to detonate or be converted in another way. The water-slurry process is also preferred since it is the most familiar, traditional and industrially available process for manufacturing such explosive compositions.

With the present invention compared to the state of the art the advantage is also obtained that ingoing crystals may be wetted with water before entering the process. For a person skilled in the art this will provide clear logistic benefits since the explosive crystals are produced, stored and transported in a water-wetted state. With the method described by Rudolf, it is obvious to a person skilled in the art that this process requires dry crystals. For a person skilled the art, handling large quantities of dry RDX and HMX crystals is associated with far greater risk than handling them in a water-wetted state. The use of the dry crystals, moreover, will always entail an extra, time-consuming drying stage in the process.

Another advantage of the present invention with the use of a mixture of RDX Type I and HMX crystals in preference to the use of an RDX Type II, which also contains HMX, is that one has far better control over the HMX content of the composition. One has much better control over both quality and quantity of HMX when it is added separately. In RDX Type II, HMX is a by-product of the manufacture of RDX and thus one has little control over the particle distribution and the purity thereof.

A summary of what is achieved by using traditional RDX Type II crystals in the present invention is illustrated in table 1.

TABLE 1

Summary of the special advantages of the present invention.

| | Known: Traditional: RDX Type II | Present invention: RDX Type I | Present invention: RDX Type I mixed with HMX |
|---|---|---|---|
| HMX content | Little control of quality and quantity of HMX since it is a by-product in the manufacture of RDX | Irrelevant | Good control of both quality and quantity of HMX |
| Fast Cook-off | Unknown, possibly OK | Does not pass | Passes |
| Pressing | Low pressing densities even at relatively high pressure | High pressing densities at low pressure | |
| Industrial applicability | Only smaller charges can be produced. More expensive production equipment. Inferior safety. | Can make larger charges. Cheaper production equipment. Better safety. | |

The equivalent pressability can be achieved for compositions covered by the present invention by using other elastomers, such as styrene-butadiene or styrene-isoprene copolymers, which are available from Kraton polymers inter alia. Other examples are Europrene and Cyanacryl (trademarks from EniChem), Krynac (trademark from Bayer polymers), Nipol (trademark from Zeon Chemicals) and Noxtite (trademark from Nippon Mektron). In recent years energy-rich elastomers have been tested for use in the field of explosive compositions, but none of these are commercially available today. The use of such energy-rich elastomers for compositions covered by the present invention is also expected to be able to provide an improved pressability. In the present invention Hy Temp 4454 has been chosen because for a number of years it has been used within the explosives industry for pressable compositions. Hy Temp is also known to have good compatibility with the explosive, which is extremely important for this type of compound.

The equivalent pressability can also be achieved for compositions covered by the present invention with the use of other plasticizers. Besides dioctyl adipate (DOA), plasticizers such as dioctyl sebacate (DOS) and isodecyl perlargonate (IDP) are also employed together with Hy Temp in explosive compositions (Amy J. Didion and K. Wayne Reed, 2001 Insensitive Munition & Energetic Materials Technology Symposium, Bordeaux, proceedings page 239). Other known plasticizers employed in the explosives industry are, for example, dioctyl maleate (DOM), dioctyl phthalate (DOP), glycidyl acid polymer (GAP) and N-alkyl-nitratoethyl nitramine (Alkyl-NENA). These plasticizers and other similar plasticizers will be ideally suited to the present invention. The use of dioctyl adipate (DOA) is preferred in the present invention together with the elastomer sold under the name Hy Temp 4454 or 4054 since this formulation is well documented and known to have good compatibility with the explosive.

EXAMPLES

In order to further describe the invention it will be illustrated by means of examples. These examples are only intended as presentations of preferred embodiments and should therefore not be considered limiting for the more general inventive concept of producing RDX Type I formulations in a water-slurry process.

Example 1

Manufacture of the explosive composition without HMX in a 1500 liter reactor.

RDX Type I (92.4 kg coarse portion and 110 kg fine portion) was fed into the reactor together with water (approximately 1000 kg) and was mixed by stirring. The average crystal size of the coarse portion and the fine portion was between 60-90 microns and 10-20 microns respectively. The mixture was heated to 40° C. A solution at 40° C. of Hy Temp 4454 (4.95 kg) and DOA (14.8 kg) dissolved in ethyl acetate (approximately 100 kg) was then added while stirring. The mixture was then heated, with distillation of ethyl acetate, to 100° C. After cooling the mixture was passed into a filter carriage and the product filtered off. The product (approximately 220 kg) was then dried and analysed to contain 91.5% RDX, 2.0% Hy Temp and 6.5% DOA. The product was pressed to 99.4% TMD at 981 bar. The pressing curve is illustrated in FIG. 1.

This product was then subjected to a Fast Cook-off test (according to TL-1376-800) and produced a Type IV reaction.

Example 2

Manufacture of the explosive composition with HMX in a 6000 liter reactor.

RDX Type I (350 kg coarse portion and 224 kg fine portion) and HMX (70 kg) was fed into the reactor together with water (approximately 3000 kg) and was mixed by stirring. The average crystal size of the coarse portion and the fine portion of RDX Type I was between 60-90 microns and 10-20 microns respectively. The average particle size of HMX was 10-20 microns. The mixture was heated to 40° C. A solution at 40° C. of Hy Temp 4454 (14 kg) and DOA (42 kg) dissolved in ethyl acetate (approximately 300 kg) was then added while stirring. The mixture was then quenched with water. The mixture was then heated, with distillation of ethyl acetate, to 100° C. After cooling the mixture was passed into a filter carriage and the product filtered off. The product (approximately 700 kg) was then dried and analysed to contain 82.4% RDX, 10.1% HMX, 1.8% Hy Temp and 5.7% DOA. The product was pressed to 99.2% TMD at 981 bar. The pressing curve is illustrated in FIG. 1.

This product was then subjected to a Fast Cook-off test (according to TL-1376-800) and produced a Type V reaction.

Example 3

Manufacture of the explosive composition without HMX in a 150 liter reactor.

RDX Type I (6.83 kg coarse portion and 6.83 kg fine portion) was fed into the reactor together with water (approximately 60 kg) and was mixed by stirring. The average crystal size of the coarse portion and the fine portion was between 180-240 microns and 10-20 microns respectively. The mixture was heated to 40° C. A solution at 40° C. of Hy Temp 4454 (0.335 kg) and DOA (1.005 kg) dissolved in ethyl acetate (approximately 6 kg) was then added while stirring. The mixture was then quenched with water. The mixture was then heated, with distillation of ethyl acetate, to 100° C. After cooling the mixture was passed into a filter carriage and the product filtered off. The product (approximately 15 kg) was then dried and analysed to contain 91.4% RDX, 2.0% Hy Temp and 6.6% DOA. The product was pressed to 99.5% TMD at 981 bar. The pressing curve is illustrated in FIG. 1.

Example 4

Manufacture of the explosive composition without HMX in a 150 liter reactor.

RDX Type I (4.5 kg coarse portion and 4.5 kg fine portion) was fed into the reactor together with water (approximately 60 kg) and was mixed by stirring. The average crystal size of the coarse portion and the fine portion was between 80-150 microns and 3-10 microns respectively. The mixture was heated to 40° C. A solution at 40° C. of Hy Temp 4454 (0.25 kg) and DOA (0.75 kg) dissolved in ethyl acetate (approximately 6 kg) was then added while stirring. The mixture was then quenched with water. The mixture was then heated, with distillation of ethyl acetate, to 100° C. After cooling the mixture was passed into a filter carriage and the product filtered off. The product (approximately 15 kg) was then dried and analysed to contain 89.2% RDX, 2.1% Hy Temp and 8.7% DOA. The product was pressed to 99.8% TMD at 981 bar. The pressing curve is illustrated in FIG. 1.

Example 5

Manufacture of the explosive composition without HMX in a 150 liter reactor.

RDX Type I (7.05 kg coarse portion and 7.05 kg fine portion) was fed into the reactor together with water (approximately 60 kg) and was mixed by stirring. The average crystal size of the coarse portion and the fine portion was between 80-150 microns and 3-10 microns respectively. The mixture was heated to 40° C. A solution at 40° C. of Hy Temp 4454 (0.225 kg) and DOA (0.675 kg) dissolved in ethyl acetate (approximately 6 kg) was then added while stirring. The mixture was then quenched with water. The mixture was then heated to 100° C., with distillation of ethyl acetate. After cooling the mixture was passed into a filter carriage and the product filtered off. The product (approximately 15 kg) was then dried and analysed to contain 95.0% RDX, 1.2% Hy Temp and 3.8% DOA. The product was pressed to 98.9% TMD at 981 bar. The pressing curve is illustrated in FIG. 1.

As can be seen in the drawing, the curves in FIG. 1 illustrate the density in the form of % TMD that is achieved by the individual pressing pressures. To be able to achieve a density of 99% TMD or more even at a pressure of 1000 bar is highly advantageous and not previously known. In some of the examples (examples 1-4) almost 99% density or more is achieved even at a pressure of 500 bar. This is exceptionally good and offers the potential, in preference to a more expensive casting process, for pressing very large charges compared to what was previously considered normal. Example 5 shows slightly inferior density to the others at a pressure of 500 bar. The reason for this is that this composition has a greater proportion of filler (explosive) and this reduces the pressability somewhat. On the other hand the composition referred to in example 5 also presses to approximately 99% TMD at a pressure of 1000 bar.

This is also highly advantageous and will be able to be used for larger charges than were previously considered to be normal.

The invention claimed is:

1. An explosive composition comprising explosive crystals of RDX Type I, a polyacrylic elastomer and a plasticizer, wherein the polyacrylic elastomer is Hy Temp 4454 or Hy Temp 4054, and that the plasticizer is dioctyl adipate (DOA), dioctyl sebacate (DOS), isodecyl pelargonate (IDP), dioctyl maleate (DOM) or dioctyl phthalate (DOP)

characterised in that RDX crystals represent a proportion in the range 88-96% by weight of the composition, and that the RDX crystals comprises a portion of coarse crystals with an average crystal size in the range 50 to 250 μm and a portion of finer crystals with average crystal size in the range 2 to 30 μm.

2. An explosive composition comprising explosive crystals of RDX Type I and HMX, a polyacrylic elastomer and a plasticizer, wherein the polyacrylic elastomer is Hy Temp 4454 or Hy Temp 4054, and that the plasticizer is dioctyl adipate (DOA), dioctyl sebacate (DOS), isodecyl pelargonate (IDP), dioctyl maleate (DOM) or dioctyl phthalate (DOP)

characterised in that the explosive crystals represent a proportion in the range 88-96% by weight of the total composition, that the RDX crystals comprises a portion of coarse crystals with an average crystal size in the range 50 to 250 μm and a portion of finer crystals with average crystal size in the range 2 to 30 μm, and that the HMX crystals represent a proportion in the range from 5 to 20% by weight of the explosive crystals in the composition.

3. An explosive composition according to claim 1 or 2, characterised in that the explosive crystals represent from 90 to 94% by weight of the composition.

4. An explosive composition according to claim 1 or 2, characterised in that the coarse portion of the RDX crystals comprises crystals with an average size in the range 60 to 170 μm, and that the fine portion of the RDX crystals has an average size in the range 5-20 μm.

5. An explosive composition according to claim 1 or 2, characterised in that the coarse portion of the RDX crystals represents from 25 to 75% by weight.

6. An explosive composition according to claim 2, characterised in that the HMX crystals have an average size in the range from 2 to 30 μm.

7. An explosive composition produced in a water-slurry process, characterised in that it comprises comprising 88-96% of a coarse-grained and fine-grained explosive crystals of RDX Type I and a binder system consisting of a polyacrylic elastomer and a plasticizer, and where RDX is present in a proportion of relatively coarse-grained and a proportion of fine-grained crystals wherein the coarse portion of the RDX crystals comprises crystals with an average size in the range 60 to 170 μm, and that the fine portion of the RDX crystals has an average size in the range 5-20 μm.

8. An explosive composition produced in a water-slurry process, characterised in that it consists of 88-96% of explosive crystals and a binder system comprising a polyacrylic elastomer and a plasticizer, where the explosive crystals are a mixture of RDX crystals of Type I and HMX crystals, and where RDX is present in a proportion of relatively coarse-grained and a proportion of fine-grained crystals, wherein the coarse portion of the RDX crystals comprises crystals with an average size in the range 60 to 170 μm, and that the fine portion of the RDX crystals has an average size in the range 5-20 μm.

9. An explosive composition according to claim 7 or 8, characterised in that the proportion of explosive crystals represents from 90 to 94% by weight and preferably from 91 to 93% by weight of the total composition.

10. An explosive composition according to claim 7 or 8, characterised in that the coarse portion of the RDX crystals represents from 25 to 75% by weight.

11. An explosive composition according to claim 7 or 8, characterised in that the polyacrylic elastomer is Hy Temp 4454 or Hy Temp 4054, and that the plasticizer is dioctyl adipate (DOA), dioctyl sebacate (DOS), isodecyl pelargonate (IDP), dioctyl maleate (DOM) or dioctyl phthalate (DOP).

12. An explosive composition according to claim 8, characterised in that the proportion of HMX crystals represents from 5 to 20% by weight, of the total quantity of explosive crystals in the composition.

13. An explosive composition according to claim 8, characterised in that the HMX crystals have an average size in the range from 2 to 30 μm.

14. An explosive composition according to claim 3, characterised in that the explosive crystals represent from 91 to 93% by weight of the composition.

15. An explosive composition according to claim 4, characterised in that the coarse portion of the RDX crystals comprises crystals with an average size in the range 60-90 μm, and that the fine portion of the RDX crystals has an average size in the range 5-20 μm.

16. An explosive composition according to claim 4, characterised in that the coarse portion of the RDX crystals comprises crystals with an average size in the range 60 to 170 μm, and that the fine portion of the RDX crystals has an average size in the range 12-18 μm.

17. An explosive composition according to claim 4, characterised in that the coarse portion of the RDX crystals comprises crystals with an average size in the range 60-90 μm, and that the fine portion of the RDX crystals has an average size in the range 12-18 μm.

18. An explosive composition according to claim 5, characterised in that the coarse portion of the RDX crystals represents from 35 to 65% by weight.

19. An explosive composition according to claim 5, characterised in that the coarse portion of the RDX crystals represents from 44 to 56% by weight.

20. An explosive composition according to claim 2, characterised in that the portion of HMX crystals represents from 5 to 15% by weight of the total quantity of explosive crystals in the composition.

21. An explosive composition according to claim 2, characterised in that the portion of HMX crystals represents from 9 to 11% by weight of the total quantity of explosive crystals in the composition.

22. An explosive composition according to claim 6, characterised in that the HMX crystals have an average size in the range from 5 to 20 μm.

23. An explosive composition according to claim 6, characterised in that the HMX crystals have an average size in the range from 8 to 14 μm.

24. An explosive composition according to either of claim 7 or 8, characterised in that the coarse portion of the RDX crystals comprising crystals with an average size in the range 60-90 μm, and that the fine portion of the RDX crystals has an average size in the range 5-20 μm.

25. An explosive composition according to either of claim 7 or 8, characterised in that the coarse portion of the RDX crystals comprising crystals with an average size in the range 60 to 170 μm, and that the fine portion of the RDX crystals has an average size in the range 12-18 μm.

26. An explosive composition according to either of claim 7 or 8, characterised in that the coarse portion of the RDX crystals comprising crystals with an average size in the range 60-90 μm, and that the fine portion of the RDX crystals has an average size in the range 12-18 μm.

27. An explosive composition according to claim 10, characterised in that the coarse portion of the RDX crystals represents from 35 to 65% by weight.

28. An explosive composition according to claim 10, characterised in that the coarse portion of the RDX crystals represents from 44 to 56% by weight.

29. An explosive composition according to claim 12, characterised in that the proportion of HMX crystals represents from 5 to 15% by weight—of the total quantity of explosive crystals in the composition.

30. An explosive composition according to claim 12, characterised in that the proportion of HMX crystals represents from 9 to 11% by weight of the total quantity of explosive crystals in the composition.

31. An explosive composition according to claim 13, characterised in that the HMX crystals have an average size in the range from 5 to 20 μm.

32. An explosive composition according to claim 13, characterised in that the HMX crystals have an average size in the range from 8 to 14 μm.

33. A bimodal explosive composition comprising explosive crystals of RDX, alone or optionally in combination with explosive crystals of HMX, a polyacrylic elastomer and a plasticizer, wherein the composition has a pressability of 98% TMD or greater at a pressure of 1000 bar or less, and wherein the polyacrylic elastomer is Hy Temp 4454 or Hy Temp 4054, and that the plasticizer is dioctyl adipate (DOA), dioctyl sebacate (DOS), isodecyl pelargonate (IDP), dioctyl maleate (DOM) or dioctyl phthalate (DOP), and further wherein RDX crystals represent a proportion in the range 88-96% by weight of the composition, and that the RDX crystals comprises a portion of coarse crystals with an average crystal size in the range 50 to 250 μm and a portion of finer crystals with average crystal size in the range 2 to 30 μm.

34. A bimodal explosive composition according to claim 33, having a pressability of 98% TMD or greater at a pressure of 500 bar or less.

35. A bimodal explosive composition according to claim 33, wherein the explosive crystals are RDX alone, and wherein the composition has a pressability of 98% TMD or greater at a pressure in the range of 250 to 1000 bar.

36. A bimodal explosive composition according to claim 33, having a pressability of 99% TMD or greater at a pressure in the range of 500 to 1000 bar.

37. A bimodal explosive composition according to claim 33, having a pressability of 99% TMD or greater at a pressure in the range of 250 to 500 bar.

38. A bimodal explosive composition comprising explosive crystals of RDX and HMX, a polyacrylic elastomer and a plasticizer, wherein the composition has a pressability of 98% TMD or greater at a pressure of 1000 bar or less, wherein the polyacrylic elastomer is Hy Temp 4454 or Hy Temp 4054, and that the plasticizer is dioctyl adipate (DOA), dioctyl sebacate (DOS), isodecyl pelargonate (IDP), dioctyl maleate (DOM) or dioctyl phthalate (DOP), and further wherein the explosive crystals represent a proportion in the range 88-96% by weight of the total composition, that the RDX crystals comprises a portion of coarse crystals with an average crystal size in the range 50 to 250 μm and a portion of finer crystals with average crystal size in the range 2 to 30 μm, and that the HMX crystals represent a proportion in the range from 5 to 20% by weight of the explosive crystals in the composition.

* * * * *